United States Patent [19]

Casagrande et al.

[11] Patent Number: 4,861,300

[45] Date of Patent: Aug. 29, 1989

[54] POOL FLOTATION DEVICE

[76] Inventors: Angelo F. Casagrande; Rocco J. Casagrande, both of 251 Highview La., Media, Pa. 19063

[21] Appl. No.: 227,787

[22] Filed: Aug. 3, 1988

[51] Int. Cl.[4] ..... B63C 9/08

[52] U.S. Cl. ..... 441/81; 441/131

[58] Field of Search ..... 441/80, 81, 88, 89–101, 441/106–119, 125–133, 136

[56] References Cited

U.S. PATENT DOCUMENTS

| | | | |
|---|---|---|---|
| 1,184,325 | 5/1916 | Coxey | 441/80 |
| 1,217,824 | 2/1917 | Pritchard | 441/112 |
| 2,974,331 | 3/1961 | Dize | 441/130 |
| 3,074,084 | 1/1963 | Bisch | 441/131 |
| 3,161,897 | 12/1964 | Hill | 441/130 |
| 3,332,093 | 7/1967 | Skinner et al. | 441/133 |
| 3,656,749 | 4/1972 | Reyes | 441/133 |
| 3,860,976 | 1/1975 | Suyama | 441/131 |
| 4,601,667 | 7/1986 | Hull | 441/131 |
| 4,687,452 | 8/1987 | Hull | 441/131 |

*Primary Examiner*—Sherman D. Basinger
*Assistant Examiner*—Stephen A. Avila
*Attorney, Agent, or Firm*—Gregory J. Gore

[57] ABSTRACT

A recreational flotation device for swimmers, includes a central body-supporting loop and two or more flotation pontoons. All parts are substantially cylindrical having a circular cross-section throughout their lengths. Other anatomically-shaped flotation members may be added to the loop, such as a head and cervical support pontoon. The body-supporting loop is flexible and affixed to the flotation device through apertures along their axes. This construction provides this device with extreme flexibility and adaptability to the different body positions of the swimmer.

6 Claims, 2 Drawing Sheets

FIG. 6
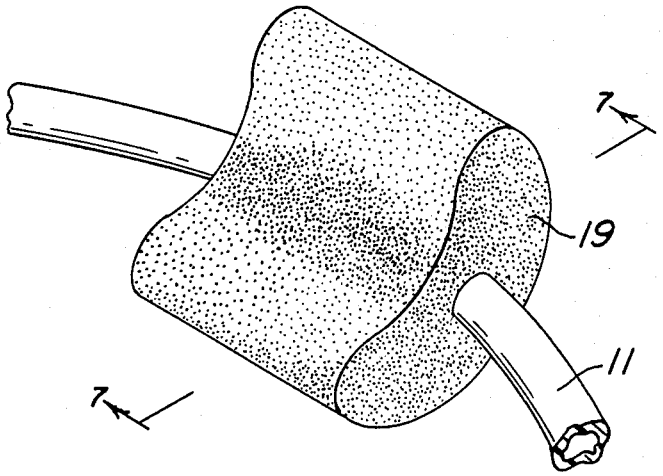
FIG. 7
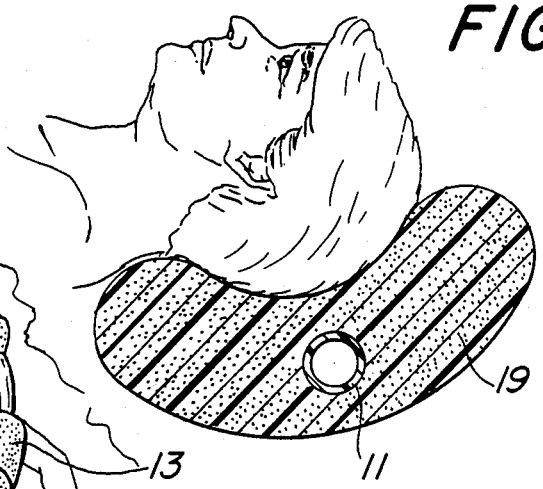
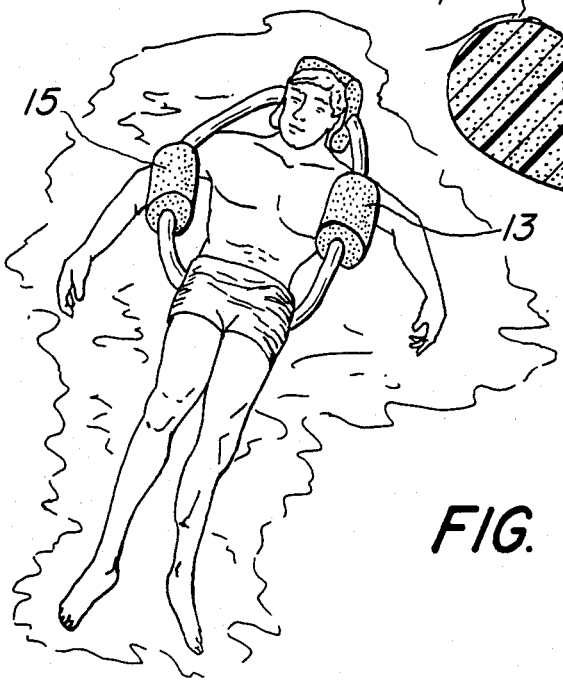
FIG. 8

POOL FLOTATION DEVICE

FIELD OF THE INVENTION

This device relates to personal flotation equipment for swimmers. Specifically, it relates to recreation devices used in a swimming pool or other bodies of water.

BACKGROUND OF THE INVENTION

Prior art recreational devices and swimming aids having buoyancy to support the user include a wide variety of flotation structures, such as chairs, rafts, ring tubes, collars, vests, etc. Of these, the devices which are not worn by the user are usually one-piece inflatable rafts or tubes and rigid structures, such as chairs and reclining lounges which are fitted with floats. While some of these devices have a limited degree of convertibility, they are basically unadjustable and intended for a single, fixed body position of the bather.

SUMMARY OF THE INVENTION

The present invention addresses the need for an adjustable, body-supporting buoyancy device for pool bathers which can be adapted for a variety of body positions. The present device readily adapts to reclining or sitting positions. Furthermore, the present invention can accommodate different bathers of varying size and weight by adding or subtracting any of the parts. Also, the present device has the advantages of being economical with few parts and having a long life expectancy.

The present invention includes a few simple structures, including a central body-supporting loop and two or more flotation pontoons. All parts are substantially cylindrical having a circular cross-section throughout their length. Other anatomically-shaped flotation members may be added to said loop, such as a head and cervical support pontoon. The body-supporting loop is flexible and affixed to the flotation devices through apertures along their axis. Therefore, the flotation devices are positionally symmetric about their affixation point and can easily be rotated without changing the relationship between the parts or requiring any rigid connection. This is important because it allows the cylindrical flotation pontoons to be positioned at any point along the length of the supporting loop. This feature provides this device with extreme flexibility and adaptability to many different possible uses as will be further described herein. Other uses and configurations that this device may take will be obvious to those of ordinary skill in the art from the following drawings and description.

BRIEF DESCRIPTION OF THE DRAWINGS

FIG. 6 is an isometric view of a cervical support pontoon.

FIG. 7 is a cross-section taken from FIG. 6 showing the anatomical shape of the head support pontoon shown in FIG. 6.

FIG. 8 is a top isometric view showing the floating position of a bather using three pontoons, including the head and cervical support pontoon shown in FIGS. 6 and 7.

DESCRIPTION OF THE PREFERRED EMBODIMENT

Figure 1:
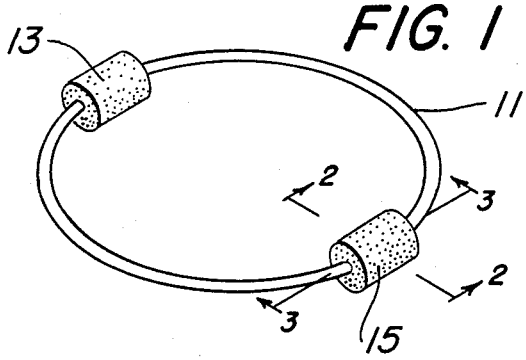
FIG. 1 is an isometric view of the invention.
Figure 2:
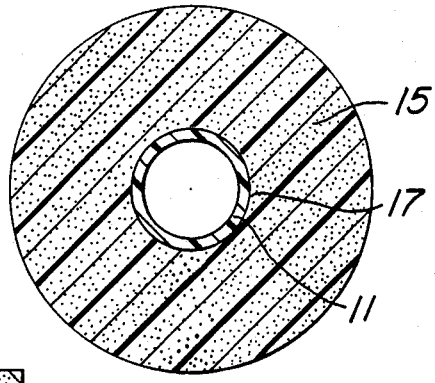
FIG. 2 is a lateral sectional view of a pontoon taken from FIG. 1.
Figure 3:
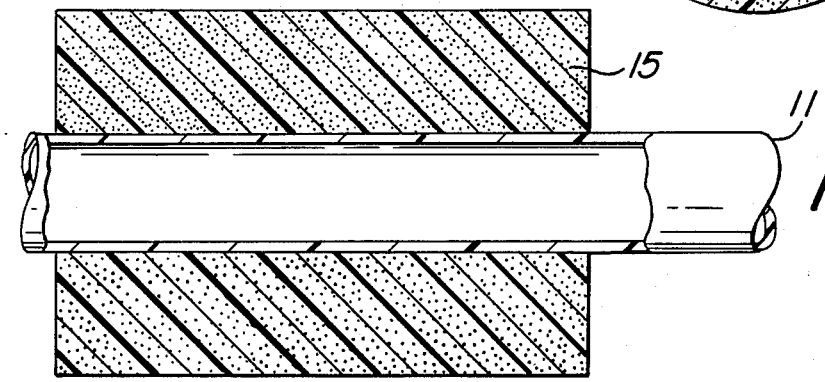
FIG. 3 is a longitudinal sectional view of a pontoon taken from FIG. 1.

Referring now to FIG. 1, body support loop member 11 interconnects cylindrical flotation devices 13 and 15. The cylindrical flotation members may be constructed of any material, including inflatable plastic, but are preferably a non-inflatable, rigid material such as polystyrene or closed cell vinyl-coated foam. Referring to FIGS. 2 and 3, the body-supporting loop 11 is passed through an axial bore 17 located in both flotation pontoons and is thereafter joined at a splice joint to form an endless loop. The flexible body-supporting loop is preferably of a comfortable diameter, say 2 inches, and is buoyant so that it also floats. This member aids in support of the bather (as a result of its airtightness), and the floating characteristic makes the entire device easier to handle in the water. Flexible plastic or PVC tubing has been shown to be a good loop material. Also, it can be provided in interlocking sections to accommodate different body sizes and for ease of shipment.

Figure 4:
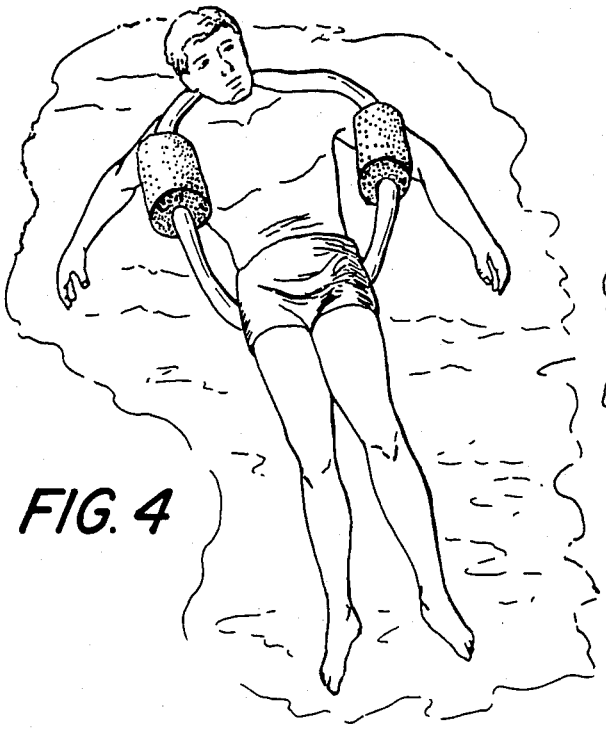
FIG. 4 shows the present device arranged to support a bather in a reclining position.
Figure 5:
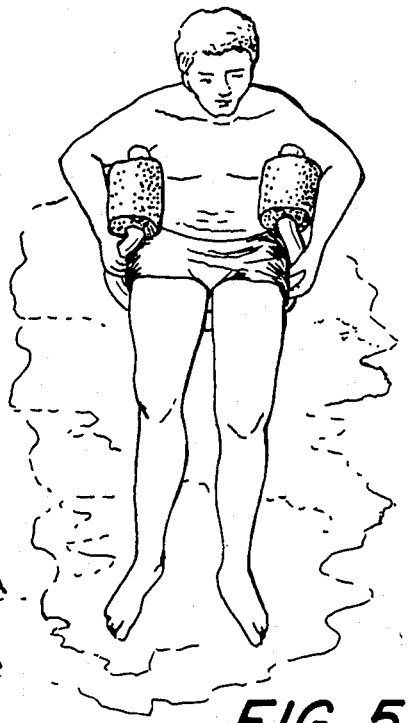
FIG. 5 shows the present device arranged in a manner to support a bather in a sitting position.

Referring now to FIGS. 4 and 5, various positions and uses are shown that are possible by positioning the pontoons at different points on the loop and locating the loop structure in different ways around the bather's body. The positions shown include a comfortable reclining position and a sitting position, as well as positions to exercise the upper or lower body. It should be clear that the uses of this device are limited only by the imagination of the bather. Furthermore, it should be readily apparent that this device is an extremely inexpensive piece of water recreation equipment which is versatile and can be very durable, using modern materials such as plastic and polystyrene.

Referring now to FIGS. 6, 7 and 8, the additional use of an extra anatomically-shaped pontoon 19 provides cervical and head support and is fitted about body support loop 11 in a fashion similar to the other pontoons 13 and 15. FIG. 7 shows how the pontoon 19 provides head and cervical support of the user. FIG. 8 shows this three-pontoon configuration in use.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A personal flotation device for use in a swimming pool or other body of water, comprising:

a. a shapeless body-supporting endless, freely flexible, buoyant loop having a circular cross-section, capable of easily conforming to the user's body, b. two or more cylindrical removable flotation pontoons freely movable about and encircling said body-supporting loop, said pontoons having a diameter substantially greater than the diameter of said body-supporting loop and being substantially more buoyant than said loop, and c. at least one, anatomically-shaped pontoon affixed to said body-supporting loop.

2. The personal flotation device of claim 1 wherein said body-supporting loop is hollow.

3. The personal flotation device of claim 2 further described in that said loop passes through an axial bore in each pontoon.

4. The personal flotation device of claim 3 consisting only of one loop and two or more pontoons.

5. The personal flotation device of claim 1 wherein said body-supporting loop is composed of a flexible floatable material, such as a closed-cell vinyl foam.

6. The personal flotation device of claim 1 further described in that said body-supporting loop is non-inflatable.

* * * * *